United States Patent [19]

deSouza et al.

[11] Patent Number: 4,631,453

[45] Date of Patent: Dec. 23, 1986

[54] TRIGGERABLE CERAMIC GAS TUBE VOLTAGE BREAKDOWN DEVICE

[75] Inventors: Alwyn A. DeSouza; Hans W. Oertel, both of Goleta, Calif.

[73] Assignee: Joslyn Mfg. and Supply Co., Chicago, Ill.

[21] Appl. No.: 526,988

[22] Filed: Aug. 29, 1983

[51] Int. Cl.[4] ..... H01J 11/04; H01J 13/48; H01J 15/04; H05B 37/00

[52] U.S. Cl. ..... 315/340; 313/325; 313/268; 313/595; 315/124; 361/120; 361/129

[58] Field of Search ..... 313/325, 231.11, 256, 313/268, 289, 308, 594, 595, 596, 602; 315/340, 339, 124, 207, 241 P; 361/120, 129

[56] References Cited

U.S. PATENT DOCUMENTS

| | | | |
|---|---|---|---|
| 3,350,604 | 10/1967 | Erickson | 315/241 P X |
| 3,989,973 | 11/1976 | Lange et al. | 361/120 X |
| 3,989,985 | 11/1976 | Lange et al. | 361/120 |
| 4,056,753 | 11/1977 | Keikichi et al. | 313/325 |
| 4,084,208 | 4/1978 | Bazarian et al. | 313/308 X |
| 4,287,548 | 9/1981 | Hahndorff | 361/120 |
| 4,410,831 | 10/1983 | Shigemori et al. | 313/325 |

FOREIGN PATENT DOCUMENTS

| | | | |
|---|---|---|---|
| 2641514 | 3/1978 | Fed. Rep. of Germany | 313/325 |

*Primary Examiner*—Saxfield Chatmon
*Attorney, Agent, or Firm*—Mason, Kolehmainen, Rathburn & Wyss

[57] ABSTRACT

A triggerable ceramic gas tube voltage breakdown device, particularly adapted for use in an electrical circuit for controlling the light output of a photoflash lamp, includes means for reducing the attenuation of an electrical trigger pulse in the region of the electrode gap due to the ceramic spacer tube. The electric field intensity in the region of the electrode gap resulting from the trigger pulse may be enhanced by disposing annular conductive material in the region and by connecting that material to a source of the trigger pulses. Alternatively or in conjunction therewith, the configuration of the ceramic spacer tube may be altered by removing material from the ceramic spacer tube in the region of the electrode gap, thereby enhancing the electric field intensity in that region resulting from the trigger pulses.

29 Claims, 13 Drawing Figures

TRIGGERABLE CERAMIC GAS TUBE VOLTAGE BREAKDOWN DEVICE

BACKGROUND OF THE INVENTION

A. Field of the Invention

The device of the present invention generally relates to gas tube voltage breakdown devices, often commonly referred to as surge arresters, and, more particularly, to a new and improved hermetically sealed gas tube voltage breakdown device having a ceramic insulating spacer and a trigger electrode and particularly adapted for repetitive use as a voltage breakdown device in an electrical circuit, for example, in an electrical circuit for controlling the light output of a photoflash lamp.

B. Description of the Prior Art

Hermetically sealed gas tube voltage breakdown devices, commonly known as and used as surge arresters, are old and well-known in the art. For example, pertinent prior art gas tube voltage breakdown devices or surge arresters are disclosed in U.S. Pat. Nos. 3,588,576; 4,084,208; and 4,287,548. Typically, such devices are used as surge arresters to protect electrical equipment from damage or destruction due to the presence of overvoltage surges. However, such devices also have been used in electrical circuits requiring a voltage breakdown device capable of conducting relatively high currents.

In the prior art, electrical circuits have been used to control the light output of photoflash lamps. Such circuits generally supply high voltage across a capacitor to store a charge for lighting a photoflash lamp. In addition, switching means in the form of a manual switch or a photoresistor are used to extinguish the photoflash lamp when sufficient illumination has been provided. Examples of circuit elements used to extinguish the photoflash lamp by electrically shorting a storage capacitor and/or the photoflash lamp are cold cathode thyratrons or hermetically sealed gas tube voltage breakdown devices or surge arresters utilizing glass spacer tubes. Glass spacer tubes used in such an application have included a trigger electrode disposed about the glass spacer tube in the region of the electrode gap to increase the electric field intensity in that region upon the presence of a trigger pulse, thereby to cause the sparkover or breakdown of the electrode gap and electrical current conduction through the voltage breakdown device.

Generally, the life expectancy of a voltage breakdown device with a glass spacer tube used in such an application is relatively short since the glass spacer tube tends to become embrittled. The use of a gas tube voltage breakdown device utilizing a ceramic spacer tube would result in a higher life expectancy since the ceramic would not become embrittled and deteriorate as rapidly as the glass spacer tube. However, due to the significantly higher dielectric constant of the ceramic spacer tube as compared to the glass spacer tube, the application of an external trigger pulse in the region of the electrode gap of a typical ceramic gas tube voltage breakdown device would have an insufficient effect upon the electric field intensity in that region and would thus be unsuitable for causing sparkover or gap breakdown and current conduction through the voltage breakdown device.

SUMMARY OF THE INVENTION

An object of the present invention is to provide a new and improved gas tube voltage breakdown device or surge arrester.

Another object of the present invention is to provide a new and improved spacer tube for use in a gas tube voltage breakdown device or surge arrester.

Another object of the present invention is to provide a new and improved triggerable gas tube voltage breakdown device or surge arrester.

Another object of the present invention is to provide a new and improved triggerable hermetically sealed ceramic gas tube voltage breakdown device or surge arrester for use in an electrical circuit, such as an electrical circuit for controlling the light output of a photoflash lamp.

Briefly, the device of the present invention comprises a new and improved hermetically sealed gas tube voltage breakdown device or surge arrester particularly adapted for use as a voltage breakdown device in an electrical circuit for controlling the light output of a photoflash lamp. The device includes a trigger electrode disposed about the region of the electrode gap and means for reducing the attenuation of an electrical trigger pulse or signal due to the ceramic spacer tube of the device. The ceramic spacer tube may be formed from two elongated cylindrical spacer tube halves joined together by annular conductive material in the region of the electrode gap that serves as an integrally formed trigger electrode. Alternatively or in conjunction therewith, the configuration of the ceramic spacer tuve may be altered by removing material from the ceramic spacer tube in the region of the electrode gap to reduce the attenuation of the trigger pulse in that region caused by the thickness of a ceramic spacer tube. By connecting the integrally formed trigger electrode to a trigger pulse source or alternatively by disposing a non-integral trigger electrode about the region of the electrode gap and connecting that trigger electrode to a trigger pulse source, the electric field intensity in the region of the electrode gap due to the trigger pulse is sufficient to initiate sparkover or gap breakdown and current conduction through the device.

BRIEF DESCRIPTION OF THE DRAWING

The above and other objects and advantages and novel features of the present invention will become apparent from the following detailed description of the embodiments of the invention illustrated in the accompanying drawing wherein.

DESCRIPTION OF THE PREFERRED EMBODIMENT

Figure 1:
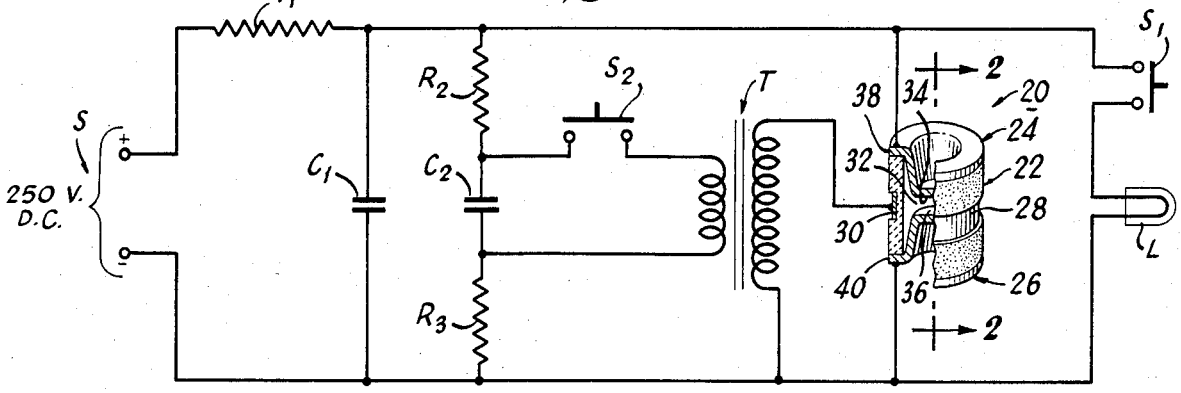
FIG. 1 is a schematic view of an electrical circuit for controlling the light output of a photoflash lamp utilizing a triggerable hermetically sealed gas tube voltage breakdown device constructed in accordance with the principles of the present invention.
Figure 2:
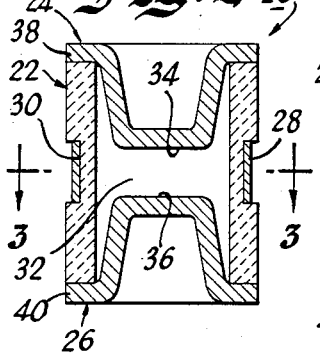
FIG. 2 is a cross sectional view of the voltage breakdown device of FIG. 1 taken along line 2—2 of FIG. 1.
Figure 4:
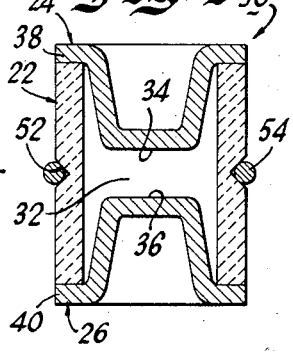
FIGS. 4–6 are cross sectional views of alternative embodiments of hermetically, sealed, triggerable gas tube voltage breakdown devices constructed in accordance with the principles of the present invention.
Figure 5:
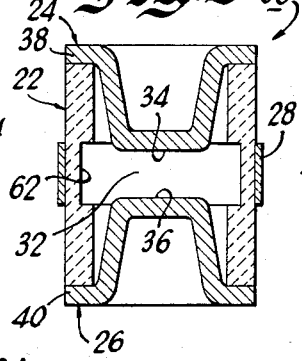
Figure 6:
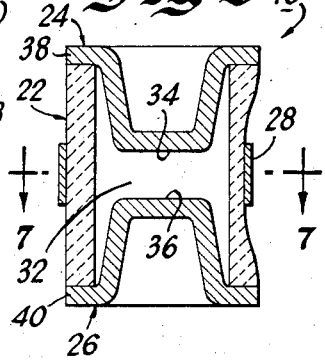
Figure 3:
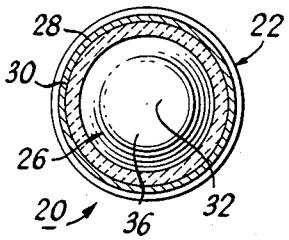
FIG. 3 is a transverse cross sectional view of the device of FIG. 2 taken along line 3—3 of FIG. 2.

Referring to the drawing and initially to FIGS. 1—3, there is illustrated a new and improved hermetically sealed, triggerable gas tube voltage breakdown device 20 (FIGS. 1-3) particularly adapted for use as a voltage breakdown device in an electrical circuit, for example, in an electrical circuit (FIG. 1) for controlling the light output of a photoflash lamp L. In accordance with an important feature of the present invention, the device 20 includes a ceramic insulating spacer tube or spacer 22, preferably formed from alumina; a pair of generally cup-shaped metal gap electrodes 24 and 26; and a metal trigger electrode 28. In the embodiment of FIGS. 1-3, the trigger electrode 28 is in the form of an elongated metal band or ring disposed in a generally U-shaped elongated recess 30 formed in and along the outer periphery of the spacer 22 in the region of an electrode gap 32 defined by the most closely spaced portions 34 and 36 respectively of the electrodes 24 and 26. Radially outwardly extending annular shoulder portions 38 and 40 of the electrodes 24 and 26, respectively, are sealed to the opposite longitudinal ends of the spacer 22 to form the hermetically sealed device 20.

In order to maintain a high direct current voltage breakdown characteristic of the gap 32 for use in the electrical circuit of FIG. 1, the spacing between the electrodes 24 and 26 forming the gap 32 preferably should be greater than or equal to two millimeters; and the device 20 should be internally pressurized with an inert gas. In addition, in order to operate over an acceptable number of repetitive duty cycles when used as a voltage breakdown device in the electrical circuit of FIG. 1, the portions 34 and 36 of the electrodes 24 and 26 should be coated with a low work function coating, consisting of metal and/or metal-salts, that functions as a getter for absorbing or chemically binding the non-inert gases that are released from the surfaces of the electrodes 24 and 26 due to the high currents flowing through the device 20.

In a specific embodiment of the present invention, the wall thickness along the length of the spacer tube 22 outside of the recess 30 is in the range from about 0.040 inch to about 0.045 inch; and the reduced wall thickness of the spacer tube 22 along the length of the recess 30 may be in the range of from about 0.015 inch to about 0.030 inch and, preferably, is in the range of from about 0.020 to about 0.025 inch. The reduced wall thickness of the spacer tube 22 along the recess 30 in the region of the gap 32 significantly reduces the attenuation of an electrical trigger pulse or signal in that region caused by the relatively high dielectric constant of the ceramic spacer tube 22. Thus, a trigger pulse applied to the trigger electrode 28 is capable of causing sparkover or breakdown of the gap 32 and subsequent current conduction through the device 20.

Except for the use therein of the voltage breakdown device 20 with a ceramic insulating spacer 22, the electrical circuit of FIG. 1 is conventional per se. Essentially, a source S of direct current voltage, for example, 250 volts, charges a main storage capacitor C1 through a resistor R1 and a trigger capacitor C2 through the resistors R1, R2, and R3. When a switch S1 is closed, the photoflash lamp L is illuminated by the charge stored in the capacitor C1. When a switch S2, which may be a manual switch but more conventionally is a photoresistor, is closed, the trigger capacitor C2 is discharged through the low voltage winding of the transformer T to generate a high voltage electrical trigger pulse or signal in the high voltage winding of the transformer T, which trigger pulse is directed to the trigger electrode 28 of the device 20. The application of the trigger pulse to the trigger electrode 28 results in a greatly increased electric field intensity in the region of the gap 32, resulting in the sparkover or breakdown of the gap 32 and current conduction through the device 20, thereby discharging the capacitor C1 and electrically short circuiting and extinguishing the photoflash lamp L.

FIGS. 4-7 and 13 depect alternative embodiments of the device 20 in which the wall thickness of the spacer 22 is reduced in the region of the electrode gap 32 by various different physical modifications to the spacer 22. For example, a voltage breakdown device 50 (FIG. 4) includes a V-notch or groove 52 formed in and about the periphery of the spacer 22 to accommodate a round wire trigger electrode 54 and to provide a reduced wall thickness in the region of the electrode gap 32 in the size ranges referred to hereinabove with respect to the recess 30 (FIGS. 1-3). A voltage breakdown device 60 (FIG. 5) includes a generally U-shaped elongated recess 62 formed about the inner periphery of the ceramic spacer tube 22 to provide a reduced wall thickness in the region of the electrode gap 32 in the size ranges referred to hereinabove with respect to the recess 30 (FIGS. 1-3).

A voltage breakdown device 70 (FIGS. 6 and 7) includes an elongated flattened wall portion or surface 72 formed along a portion of one side of the spacer 22 to provide a reduced wall thickness of the spacer 22 in the region of the electrode gap 32 in the size ranges referred to hereinabove with respect to the recess 30 (FIGS. 1-3).

A voltage breakdown device 80 (FIG. 13) utilizes a thin walled ceramic spacer tube 22 having a uniform wall thickness in the size ranges referred to hereinabove with respect to the recess 30 (FIGS. 1-3) to thereby enable a trigger pulse applied to the trigger electrode 28 to sufficiently increase the electric field intensity in the region of the electrode gap 32 to cause a sparkover or breakdown of the gap 32 and current conduction through the device 80.

Figure 9:
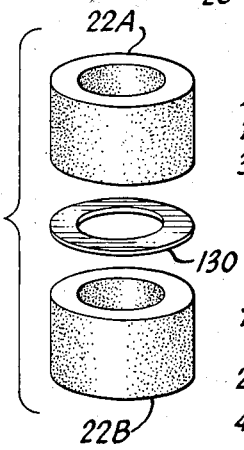
FIG. 9 is an exploded perspective view of a spacer tube for a hermetically sealed, triggerable gas tube voltage breakdown device constructed in accordance with the principles of the present invention.
Figure 13:
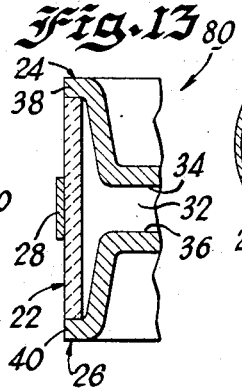
FIG. 13 is a fragmentary cross sectional view of an alternative embodiment of a hermetically sealed, triggerable gas tube voltage breakdown device constructed in accordance with the principles of the present invention.
Figure 7:
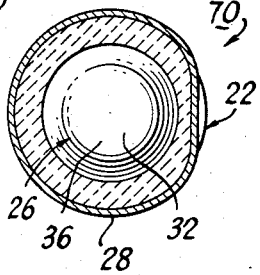
FIG. 7 is a transverse cross sectional view of the device of FIG. 6 taken along line 7—7 of FIG. 6.
Figure 8:
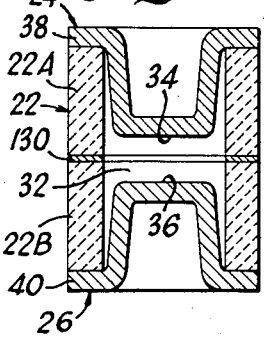
FIGS. 8 and 10–12 are cross sectional views of alternative embodiments of hermetically sealed, triggerable gas tube voltage breakdown devices constructed in accordance with the principles of the present invention.

As opposed to the embodiments of FIGS. 8 and 10-12, in each of the devices 20, 50, 60, 70 and 80 (FIGS. 1-7 and 13) the spacer 22 electrically insulates the trigger electrode 28 (54 in FIG. 4) from the region of the electrode gap 32. The voltage breakdown devices 90, 100, 110 and 120 of FIGS. 8 and 10-12, respectively, are formed from a pair of elongated, cylindrical, ceramic spacer tube halves 22A and 22B and include annular conductive material or an integrally formed trigger electrode 130 disposed therebetween. The longidutinal ends of the spacer tube halves 22A and 22B are fixedly secured together to form a unitary spacer 22 with the trigger electrode 130 disposed in the region of the electrode gap 32. The annular conductive material 130 may be a suitable brazing material, such as a silver alloy washer (FIG. 9), for brazing together the metallized ends of the spacer tube halves 22A and 22B.

Figure 10:
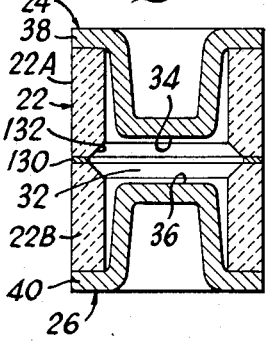
Figure 11:
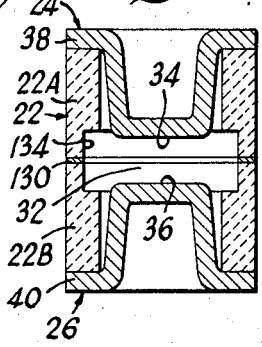
Figure 12:
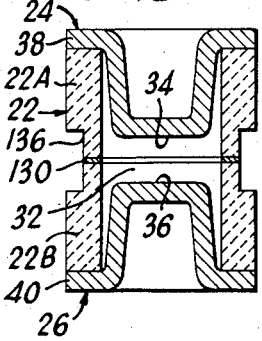

The spacer 22 (FIGS. 8 and 10–12) may be formed with a uniform wall thickness (FIG. 8) or with a reduced wall thickness in the region of the electrode gap (FIGS. 10–12). For example, the voltage breakdown device 100 (FIG. 10) includes a V-notch or groove 132 formed about the inner periphery of the spacer 22 to provide a reduced wall thickness in the region of the electrode gap 32 in the size ranges referred to hereinabove with respect to the recess 30 (FIGS. 1–3). The voltage breakdown device 110 (FIG. 11) includes a generally U-shaped elongated recess 134 disposed about the inner periphery of the spacer 22 to provide a reduced wall thickness in the region of the electrode gap 32 in the size ranges referred to hereinabove with respect to the recess 30 (FIGS. 1–3). Similarly, the voltage breakdown device 120 (FIG. 12) includes a U-shaped elongated recess 136 formed in and about the outer periphery of the spacer 22 to provide a reduced wall thickness in the region of the electrode gap 32 in the size ranges referred to hereinabove with respect to the recess 30 (FIGS. 1–3).

If desired, the devices 90, 100, 110 and 120 may each include a flat band or ring of conductive material, essentially identical to the trigger electrode 28 (FIGS. 1–7 and 13), disposed about trigger electrode 130 and along the outer periphery of the ceramic spacer tube 22 in the region of the electrode gap 32 for connecting the trigger electrode 130 to a source of trigger pulses. Alternatively, the trigger electrodes 130 may be directly electrically connected to a source of trigger pulses.

Contrary to the device depicted in U.S. Pat. No. 4,287,548 in which an exterior conductive layer or electrode 2 overlaps an interior conductive strip 3 and in which the layer or electrode 2 is directly physically and electrically connected to the gap electrode 5 and the conductive strip 3 is directly physically and electrically connected to the gap electrode 4 such that the same voltage appears across the layer or electrode 2 and the strip 3 as the voltage across the gap electrodes 4 and 5, the devices 20, 50, 60, 70, 80, 90, 100, 110 and 120 all have one of the trigger electrodes 28, 54 and 130 that are physically separated from and electrically insulated from the two gap electrodes 24 and 26 such that the trigger electrodes 28, 54 and 130 are adapted to receive a trigger voltage signal from the transformer "T" in the electrical circuit of FIG. 1 that is other than or electrically distinct from the voltage across the two gap electrodes 24 and 26. In addition, contrary to the devices depicted in FIG. 4 of U.S. Pat. No. 3,989,985 and in FIG. 3 of U.S. Pat. No. 4,410,831 which include three electrodes and two electrode gaps, a first electrode gap between the first and second electrodes and a second gap between the second and third electrodes, in the devices 20, 50, 60, 70, 80, 90, 100, 110 and 120 disclosed herein, there are two and only two gap electrodes 24 and 26 each having a single electrode gap 32 therebetween, which electrode gap 32 is the only electrode gap in those devices.

Obviously, many modifications and variations of the present invention are possible in light of the above teachings. Thus, it is to be understood that, within the scope of the appended claims, the invention may be practiced otherwise than as specifically described hereinabove. The term "voltage breakdown device" as used herein is intended to include within its scope hermetically sealed gas tube voltage breakdown devices, often referred to in the industry as surge arresters, functioning either as a surge arrester for conducting transient overvoltage surges therethrough to protect associated electrical equipment from damage or destruction due to such surges or as a voltage breakdown device in electrical circuits for conducting currents therethrough during the normal or steady state operation of such circuits. The term "ceramic" with reference to the spacer 22 is used herein in the European sense to designate a spacer 22 formed at a high temperature from nonmetallic, inorganic, earthy or clay material, other than glass.

What is claimed and desired to be secured by Letters Patent is:

1. A hermetically sealed triggerable gas tube voltage breakdown device comprising a first gap electrode, a second gap electrode, said first and second gap electrodes being the only gap electrodes in said device, an electrode gap formed between said gap electrodes, said electrode gap being the only electrode gap in said device, an elongated ceramic insulating spacer disposed between said gap electrodes and enclosing said electrode gap, and trigger electrode means, physically separated from the electrically insulated from both of said gap electrodes and adapted to receive a trigger voltage signal other than the voltage applied across said gap electrodes, for increasing the electrical field intensity in the region of said electrode gap in response to said trigger voltage signal, said trigger electrode means being entirely exteriorly disposed about the outer periphery of said insulating spacer and being axially aligned along the length of said insulating spacer with said region of said electrode gap and being electrically insulated from said electrode gap by said insulating spacer, said spacer including means disposed about the region of said electrode gap for enabling the electric field intensity in said region to be increased in response to the application of said trigger voltage signal to said trigger electrode, said enabling means comprising a thin wall portion of said insulating spacer disposed at least partially about the region of said electrode gap, said thin wall portion having a wall thickness in the range of from about 0.015 inch to about 0.030 inch.

2. A hermetically sealed triggerable gas tube voltage breakdown device as recited in claim 1 wherein said spacer has a nonuniform wall thickness along the length of said spacer, the wall thickness of said thin wall portion in the region of said electrode gap being less than the wall thickness of said insulating spacer outside of the region of said electrode gap.

3. A hermetically sealed triggerable gas tube voltage breakdown device as recited in claim 2 wherein said thin wall portion comprises a generally U-shaped elongated recess formed in and disposed about the outer periphery of said insulating spacer.

4. A hermetically sealed triggerable gas tube voltage breakdown device as recited in claim 3 wherein said trigger electrode means is disposed about the outer periphery of said insulating spacer in said elongated recess.

5. A hermetically sealed triggerable gas tube voltage breakdown device as recited in claim 2 wherein said thin wall portion comprises a generally V-shaped groove formed in and disposed about the outer periphery of said insulating spacer.

6. A hermetically sealed triggerable gas tube voltage breakdown device as recited in claim 2 wherein said thin wall portion comprises a generally U-shaped elongated recess formed in and disposed about the inner periphery of said insulating spacer.

7. A hermetically sealed triggerable gas tube voltage breakdown device as recited in claim 2 wherein said thin wall portion comprises a flattened outer wall surface of said insulating spacer.

8. A spacer for a hermetically sealed triggerable gas tube voltage breakdown device comprising elongated tubular ceramic insulating means for maintaining a pair of gap electrodes in a fixed, spaced-apart relationship defining an electrode gap, said insulating means being configured to receive a trigger electrode about its outer periphery for axial alignment along the length of said insulating spacer with said region of said electrode gap and being configured to electrically insulate said trigger electrode from said electrode gap, said insulating means including means for enabling the electric field intensity in the region of said electrode gap to be increased in response to electrical trigger signals applied to said trigger electrode, said enabling means comprising a nonuniform wall thickness along the length of said insulating means, the wall thickness of said insulating means being less in the region of said electrode gap than the wall thickness of said insulating means outside the region of said electrode gap, said wall thickness in the region of said electrode gap comprises a thin wall portion of said insulating spacer having a wall thickness in the range of about 0.015 inch to about 0.030 inch.

9. A spacer as recited in claim 8 wherein said thin wall portion comprises a generally U-shaped elongated recess formed in and disposed about the outer periphery of said insulating means.

10. A spacer as recited in claim 8 wherein said thin wall portion comprises a generally U-shaped recess formed in and disposed about the inner periphery of said insulating means.

11. A spacer recited in claim 8 wherein said thin wall portion comprises a generally V-shaped groove formed in and disposed about the inner periphery of said insulating means.

12. A spacer as recited in claim 8 wherein said thin wall portion comprises a generally V-shaped groove formed in and disposed about the outer periphery of said insulating means.

13. A hermetically sealed gas tube voltage breakdown device comprising a first gap electrode, a second gap electrode, said first and second gap electrodes being the only gap electrodes in said device, an electrode gap formed between said gap electrodes, said electrode gap being the only electrode gap in said device, an elongated ceramic insulating spacer disposed between said gap electrodes, said insulating spacer comprising two elongated tubular spacer halves, and a trigger electrode physically separated from and electrically insulated from both of said gap electrodes and adapted to receive a trigger voltage signal, said trigger electrode including conductive material disposed between said spacer halves, said spacer including a thin wall portion having a wall thickness in the range of from about 0.015 inch to about 0.030 inch.

14. A hermetically sealed gas tube voltage breakdown device as recited in claim 13 wherein said spacer halves have a nonuniform wall thickness along the length of said spacer, the wall thickness of said thin wall portion in the region of said electrode gap being less than the wall thickness of said insulating spacer outside of the region of said electrode gap.

15. A hermetically sealed gas tube voltage breakdown device as recited in claim 14 wherein said thin wall portion comprises a generally U-shaped elongated recess formed in and disposed about the outer periphery of said insulating spacer.

16. A hermetically sealed gas tube voltage breakdown device as recited in claim 13 wherein said thin wall portion comprises a generally U-shaped elongated recess formed in and disposed about the inner periphery of said insulating spacer.

17. A hermetically sealed gas tube voltage breakdown device as recited in claim 13 wherein said thin wall portion comprises a generally V-shaped groove formed in and disposed about the inner periphery of said insulating spacer.

18. An electrical circuit for controlling the light output of a photoflash lamp comprising means for extinguishing a photoflash in response to an electrical signal said extinguishing means comprising means for generating trigger voltage signals and comprising a hermetically sealed triggerable gas tube voltage breakdown device having a first gap electrode;

a second gap electrode, said first and second gap electrodes being the only gap electrodes in said device, an electrode gap formed between said gap electrodes, said electrode gap being the only electrode gap in said device, an elongated ceramic insulating spacer disposed between said gap electrodes and enclosing said electrode gap and trigger electrode means, physically separated from and electrically insulated from both of said gap electrodes and adapted to receive said trigger voltage signals that are distinct from the voltage applied across said gap electrodes, for increasing the electrical field intensity in the region of said gap electrodes in response to said trigger voltage signals, said trigger electrode means being entirely exteriorly disposed about the outer periphery of said insulating spacer and being axially aligned along the length of said insulating spacer with said region of said electrode gap and being electrically insulated from said electrode gap by said insulating spacer, said spacer including means disposed about the region of said electrode gap for enabling the electrical field intensity in said region to be increased in response to the application of said trigger voltage signals to said trigger electrode, said enabling means comprising a thin wall portion having a wall thickness from about 0.015 inch to about 0.030 inch.

19. An electrical circuit as recited in claim 18 wherein said spacer has a nonuniform wall thickness along the length of said spacer, the wall thickness of said thin wall portion in the region of said electrode gap being less than the wall thickness of said insulating spacer outside of the region of said electrode gap.

20. An electrical circuit as recited in claim 19 wherein said thin wall portion comprises a generally U-shaped elongated recess formed in and disposed about the outer periphery of said insulating spacer.

21. An electrical circuit as recited in claim 20 wherein said trigger electrode means is disposed about the outer periphery of said insulating spacer in said elongated recess.

22. An electrical circuit as recited in claim 19 wherein said thin wall portion comprises a generally V-shaped groove formed in and disposed about the outer periphery of said insulating spacer.

23. An electrical circuit as recited in claim 19 wherein said thin wall portion comprises a generally U-shaped elongated recess formed in and disposed about the inner periphery of said insulating spacer.

24. An electrical circuit as recited in claim 19 wherein said thin wall portion comprises a flattened outer wall surface of said insulating spacer.

25. An electrical circuit for controlling the light output of a photoflash lamp comprising means for extinguishing a photoflash lamp in response to an electrical signal, said extinguishing means comprising means for generating trigger voltage signals and comprising a hermetically sealed gas tube voltage breakdown device having a first gap electrode, a second gap electrode, said first and second gap electrodes being the only gap electrodes in said device, an electrode gap formed between said gap electrodes, said electrode gap being the only electrode gap in said device, an elongated ceramic insulating spacer disposed between said gap electrodes, said insulating spacer comprising two elongated tubular spacer halves; and a trigger electrode physically separated from and electrically insulated from both of said gap electrodes and adapted to receive a trigger voltage signal, said trigger electrode including conductive material disposed between said spacer halves, said spacer including a thin wall portion having a wall thickness in the range of from about 0.015 inch to about 0.030 inch.

26. An electrical circuit as recited in claim 25 wherein said spacer halves have a nonuniform wall thickness along the length of said spacer, the wall thickness of said thin wall portion in the region of said electrode gap being less than the wall thickness of said insulating spacer outside of the region of said electrode gap.

27. An electrical circuit as recited in claim 26 wherein said thin wall portion comprises a generally U-shaped elongated recess formed in and disposed about the outer periphery of said insulating spacer.

28. An electrical circuit as recited in claim 26 wherein said thin wall portion comprises a generally U-shaped elongated recess formed in and disposed about the inner periphery of said insulating spacer.

29. An electrical circuit as recited in claim 26 wherein said thin wall portion comprises a generally V-shaped groove formed in and disposed about the inner periphery of said insulating spacer.

* * * * *

UNITED STATES PATENT AND TRADEMARK OFFICE

CERTIFICATE OF CORRECTION

PATENT NO. : 4,631,453

DATED : December 23, 1986

INVENTOR(S) : deSouza et al

It is certified that error appears in the above–identified patent and that said Letters Patent are hereby corrected as shown below:

Column 6, line 30, change the word "the" to --and--.

Signed and Sealed this

Thirty-first Day of March, 1987

*Attest:*

DONALD J. QUIGG

*Attesting Officer*

*Commissioner of Patents and Trademarks*